US011135481B2

(12) United States Patent
Washida et al.

(10) Patent No.: US 11,135,481 B2
(45) Date of Patent: Oct. 5, 2021

(54) GOLF BALL

(71) Applicant: Mizuno Corporation, Osaka (JP)

(72) Inventors: Yudai Washida, Osaka (JP); Hiroaki Kawabata, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 16/823,820

(22) Filed: Mar. 19, 2020

(65) Prior Publication Data

US 2020/0298063 A1 Sep. 24, 2020

(30) Foreign Application Priority Data

Mar. 20, 2019 (JP) ..... JP2019053432

(51) Int. Cl.
*A63B 37/06* (2006.01)
*A63B 37/00* (2006.01)

(52) U.S. Cl.
CPC ..... *A63B 37/0015* (2013.01); *A63B 37/0019* (2013.01); *A63B 37/0018* (2013.01)

(58) Field of Classification Search
CPC ..... A63B 37/0012
USPC ..... 473/384, 383
See application file for complete search history.

(56) References Cited

U.S. PATENT DOCUMENTS 5,005,838 A * 4/1991 Oka ..... A63B 37/0004 40/327
6,059,671 A * 5/2000 Asakura ..... A63B 37/0004 473/383
6,478,698 B2 * 11/2002 Melvin ..... A63B 37/0004 473/378
6,503,158 B2 * 1/2003 Murphy ..... A63B 37/0004 473/384

(Continued)

FOREIGN PATENT DOCUMENTS

JP H11347150 A 12/1999
JP 3825359 B2 9/2006

(Continued)

OTHER PUBLICATIONS

Naruo, T. et al., "Aerodynamic Force Measurement of Highly Spinning Golf Ball in Uniform Flow and Trajectory Experiment," The Japan Society of Mechanical Engineers, Journal B Edition, 2004, pp. 2371-2377, vol. 70 No. 697.

(Continued)

*Primary Examiner* — Raeann Gorden
(74) *Attorney, Agent, or Firm* — Troutman Pepper Hamilton Sanders LLP; James E. Schutz; Micah B. Hensley

(57) ABSTRACT

A golf ball includes: a land portion; and a plurality of dimples each provided to be recessed with respect to the land portion. Each of the dimples has a dimple edge and a dimple plane surrounded by the dimple edge. The dimples include a plurality of eccentric dimples each having a deepest (Continued)

portion that is not located on a line connecting a center point of the dimple plane of a corresponding one of the eccentric dimples and a center point of the golf ball. The eccentric dimples have respective dimple axes that are oriented randomly in the golf ball, and each of the dimple axes is obtained in a plan view of the corresponding one of the eccentric dimples by connecting the center point of the dimple plane and the deepest portion of the corresponding one of the eccentric dimples.

1 Claim, 12 Drawing Sheets

(56) References Cited

U.S. PATENT DOCUMENTS

| | | | | |
|---|---|---|---|---|
| 6,695,721 | B1 * | 2/2004 | Tavares | A63B 37/0004 473/384 |
| D642,230 | S * | 7/2011 | Kessler | D21/662 |
| 8,337,334 | B2 * | 12/2012 | Goodwin | A63B 37/0012 473/384 |
| 2011/0065531 | A1 | 3/2011 | Goodwin | |
| 2013/0085017 | A1 | 4/2013 | Goodwin | |

FOREIGN PATENT DOCUMENTS

| | | | |
|---|---|---|---|
| JP | 3909124 | B2 | 4/2007 |
| JP | 2011056250 | A | 3/2011 |
| JP | 4982148 | B2 | 7/2012 |
| JP | 2014204950 | A | 10/2014 |
| KR | 1020080097274 | A | 9/2009 |
| KR | 1020160007472 | A | 11/2016 |

OTHER PUBLICATIONS

Japanese Office Action dated Nov. 25, 2020 in Japanese Patent Application No. 2020-046077.

* cited by examiner

GOLF BALL

This nonprovisional application is based on Japanese Patent Application No. 2019-053432 filed on Mar. 20, 2019 with the Japan Patent Office, the entire contents of which are hereby incorporated by reference.

BACKGROUND OF THE INVENTION

Field of the Invention

The present invention relates to a golf ball.

Description of the Background Art

Conventionally, in order to increase the flying distance of a golf ball, various dimples have been provided on the surface of the golf ball. For example, Japanese Patent No. 3909124 discloses a golf ball having dimples each formed to have a deepest portion that does not coincide with the center of its dimple.

SUMMARY OF THE INVENTION

The golf ball disclosed in the above-mentioned Japanese Patent No. 3909124 is provided with dimples each having a deepest portion that is displaced from its dimple center, so as to improve the aerodynamic characteristics. However, only by displacing the deepest portion of each dimple from the center of the surface thereof, the effect cannot be sufficiently achieved.

The present invention has been made in light of the above-described problems. An object of the present invention is to provide a golf ball that is reduced in air resistance so as to allow sufficient improvement in the flying distance.

In order to solve the above-described problems, a golf ball according to the present invention includes: a land portion; and a plurality of dimples each provided to be recessed with respect to the land portion. Each of the dimples has a dimple edge and a dimple plane surrounded by the dimple edge. The dimples include a plurality of eccentric dimples each having a deepest portion that is not located on a line connecting a center point of the dimple plane of a corresponding one of the eccentric dimples and a center point of the golf ball. The eccentric dimples have respective dimple axes that are oriented randomly in the golf ball. Each of the dimple axes is obtained in a plan view of a corresponding one of the eccentric dimples by connecting the center point of the dimple plane and the deepest portion of the corresponding one of the eccentric dimples.

Thereby, a turbulent flow is accelerated to reduce the air resistance, so that the flying distance can be sufficiently improved.

According to the golf ball of the present invention, a turbulent flow is caused in air around the ball, thereby allowing a reduction in air resistance. Thus, the effect of increasing the flying distance by improving the aerodynamic characteristics can be achieved.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Examples

First Embodiment

In the following, a golf ball according to the first embodiment of the present invention will be described.

The arrangement of dimples in a golf ball 100 according to the first embodiment of the present invention will be first described.

Figure 1:
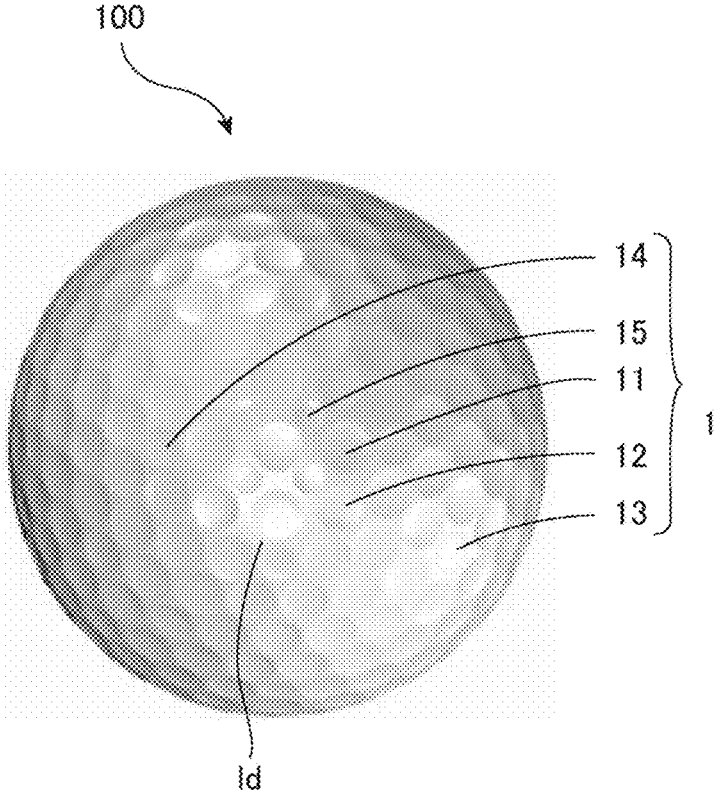
FIG. 1 is a schematic front view of a golf ball according to the first embodiment of the present invention.

FIG. 1 is a schematic front view of golf ball 100 in its entirety. Referring to FIG. 1, golf ball 100 has a dimple 1 and a land portion ld. A plurality of dimples 1 are provided on the surface of golf ball 100. Land portion ld is a surface area of golf ball 100 on which no dimple 1 is formed.

Dimples 1 may be a group of dimples having different diameters or may be dimples having the same diameter. In the case where dimples 1 having a plurality of different diameters are combined, the number of types of dimples 1 having different diameters to be combined is preferably two or more and seven or less.

In the present first embodiment, dimples 1 in golf ball 100 include an $L_1$ dimple 11, an $LS_1$ dimple 12, an $M_1$ dimple 13, an $S_1$ dimple 14, and an $SS_1$ dimple 15 in descending order of diameter size. $LL_1$ dimple 11 has the largest diameter while $SS_1$ dimple 15 has the smallest diameter. In this way, dimples 1 are a combination of dimples having a plurality of different diameters.

The number of dimples 1 is 200 or more and 400 or less, for example. The number of dimples 1 may be 366, for example. The number of $L_1$ dimples 11 is 120, for example. The number of $LS_1$ dimples 12 is 134, for example. The number of $M_1$ dimples 13 is 72, for example. The number of $S_1$ dimples 14 is 32, for example. The number of $SS_1$ dimples 15 is 8, for example.

The method of arranging dimples 1 on the surface of golf ball 100 is not particularly limited as long as excellent flight symmetry can be achieved. Dimples 1 may be arranged in any pattern in accordance with the desired aerodynamic characteristics of the golf ball. Preferably, it is recommendable that a dimple is disposed in each of areas obtained by sectioning a regular polyhedron as an imaginary shape of a spherical surface. The regular polyhedron may be an icosahedron, a dodecahedron, an octahedron, and the like. In golf ball 100 in the present first embodiment, a dimple is disposed in each of triangle areas obtained by sectioning an octahedron as an imaginary shape of a spherical surface.

Then, the structure of dimple 1 will be described in detail.

Figure 2:
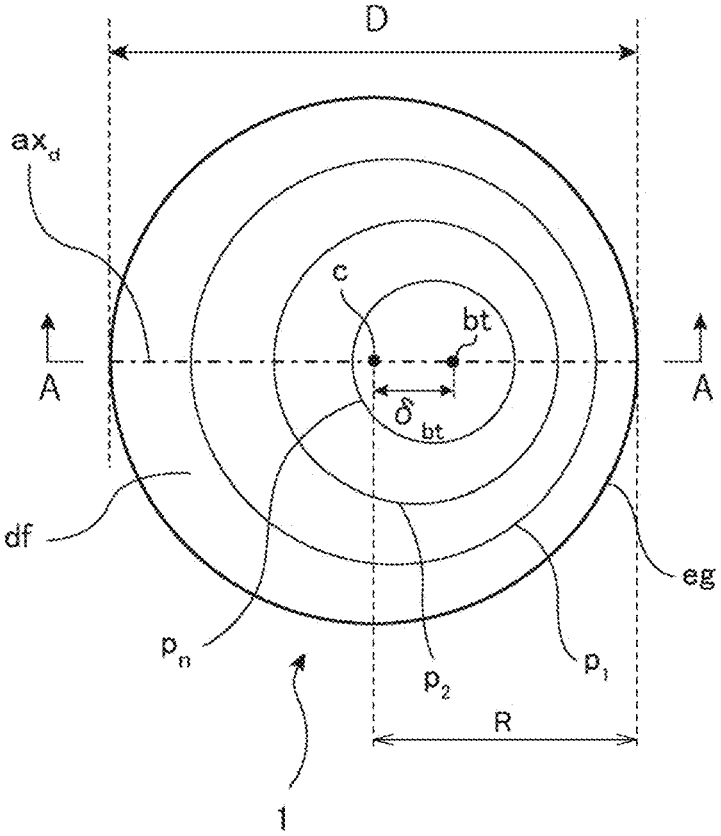
FIG. 2 is a plan view of a dimple of the golf ball according to the first embodiment of the present invention.
Figure 3:
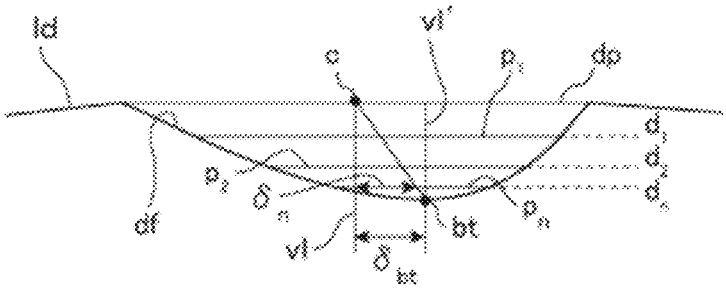
FIG. 3 is a cross-sectional view taken along a line A-A in FIG. 2.

FIG. 2 is a plan view of dimple 1. The plan view in the present first embodiment is a view of dimple 1 seen from the point of view at which a dimple plane dp (described later) can be seen as a true circle. FIG. 3 shows a cross section taken along a line A-A in FIG. 2 and is a view of a cross section obtained by cutting dimple 1 along a line passing through a center point c of dimple plane dp and a deepest portion bt of dimple 1. For convenience of explanation about the configuration of dimple 1, each of FIGS. 2 and 3 shows circular openings $p_1$, $p_2$ and $p_n$ appearing at their respective cross sections of dimple 1. FIG. 3 does not show diagonal lines in such a cross section.

In FIGS. 2 and 3, dimple 1 is formed as a concave region that is recessed with respect to land portion ld toward the center of golf ball 100. The concave region has a surface as a dimple surface df. At the boundary between land portion ld and dimple surface df, a dimple edge eg having a true circle shape appears as shown in FIG. 2. Dimple edge eg is a boundary line appearing on the surface of golf ball 100 as a tangent between golf ball 100 and an imaginary planar-shaped cover placed on dimple 1. In the present first embodiment, the circle of the flat plane surrounded by dimple edge eg is defined as a "dimple plane dp".

Various characteristics of dimple 1 can be defined with reference to dimple plane dp. For example, dimple 1 has: a diameter D corresponding to the diameter of dimple plane dp; and an area S corresponding to the area of dimple plane dp. Dimple 1 has a volume V corresponding to the volume of the region surrounded by dimple plane dp and dimple surface df. Dimple 1 has a depth B corresponding to the longest vertical distance from dimple plane dp to dimple surface df.

Deepest portion bt of dimple 1 is a point on dimple surface df at which an axis line vl' has the longest length when this axis line vl' extends vertically from dimple plane dp to dimple surface df. Axis line vl' extends in parallel with a line connecting center point c of dimple plane dp and the center point of golf ball 100 (this line will be hereinafter referred to as a "dimple vertical line vl"). Deepest portion bt of each of dimples 1 provided in golf ball 100 according to the present first embodiment is not located on dimple vertical line vl. In other words, in a plan view of dimple 1, deepest portion bt does not coincide with center point c of dimple plane dp.

In the present invention, a dimple defined as an "eccentric dimple" is configured such that, in a plan view of dimple 1, center point c of dimple plane dp and deepest portion bt of dimple 1 do not coincide with each other but are displaced from each other by a prescribed amount. All of dimples 1 in the present first embodiment are eccentric dimples. In the following first embodiment, dimple 1 will be described as an "eccentric dimple 1" as appropriate. Eccentric dimple 1 further includes the following features.

Referring to FIG. 3, at each of cut sections obtained by cutting eccentric dimple 1 in parallel with dimple plane dp at an arbitrary depth $d_n$ (n is an integer) from dimple plane dp, an opening $p_n$ having a true circle appears at the boundary between each cut section and dimple surface df. FIG. 2 shows openings $p_1$, $p_2$ and $p_n$ appearing when eccentric dimple 1 is cut at depths $d_1$, $d_2$ and $d_n$, respectively. The center point of opening $p_n$ is defined as $c_n$. Center point $c_n$ of opening $p_n$ is displaced by $\delta_n$ from center point c of dimple plane dp in a plan view or in a cross-sectional view shown in FIG. 3, and also displaced by a maximum displacement $\delta_{bt}$ at deepest portion bt of eccentric dimple 1.

The ratio of maximum displacement $\delta_{bt}$ to radius R of dimple 1 (that is, $\delta_{bt}/R$) is defined as a displacement ratio Q. Displacement ratio Q is preferably 0.1 or more and 0.4 or less. By setting displacement ratio Q in this value range, excellent aerodynamic characteristics can be achieved. Furthermore, in consideration of the formability in manufacturing golf ball 100, displacement ratio Q is more preferably 0.2 or more and 0.3 or less.

Displacement ratio Q may be the same value in all of eccentric dimples 1 provided in golf ball 100 or may be different values depending on radius R of eccentric dimples 1. Alternatively, displacement ratio Q may be different values in all of eccentric dimples 1. In the case where displacement ratio Q is different in all of eccentric dimples 1, displacement ratio Q is represented by the equation of $Q=0.1+0.3*\chi 2$, for example. In this case, $\chi 2$ showing randomness may be uniformly distributed random numbers with a range of 0 to 1, or may be eccentrically distributed random numbers.

As further features of eccentric dimple 1, a virtual dimple is defined that is formed as a spherical dome having: a circular bottom surface having the same area as that of dimple plane dp; and a height that is the same as dimple depth B of eccentric dimple 1. In this case, the radius of opening $p_n$ obtained by cutting eccentric dimple 1 at an arbitrary depth $d_n$ is the same as the radius of the opening of the above-mentioned virtual dimple at arbitrary depth $d_n$. The volume of the eccentric dimple can be calculated by integrating the cross section in the depth direction. Thus, both eccentric dimples 1 and non-eccentric dimples are not different in volume as long as their dimple diameters are the same and their dimple depths are the same. Since eccentric dimple 1 according to the present invention has such characteristics, the flexibility in designing a dimple can be increased.

Furthermore, in eccentric dimple 1, the change ratio $(\delta_n-\delta_n-1)$ $(d_n-d_n1)$ of displacement amount $\delta_n$ to dimple depth $d_n$ may be a fixed value or may conform to any continuous function with no inflection point. Thereby, dimple surface df can be formed as a smooth curved surface.

The above description has been made with regard to eccentric dimple 1 having deepest portion bt that is converged at one point, but eccentric dimple 1 may have an eccentric truncated cone shape formed such that its bottom portion has a circular planar shape. In this case, the center point of the circular flat plane forming the bottom portion of eccentric dimple 1 is displaced by displacement amount $\delta_{bt}$ from center point c of dimple plane dp in a plan view.

Also, a virtual dimple is further defined that is formed to have a truncated cone shape having: a circular upper surface having the same area as that of dimple plane dp of eccentric dimple 1 having the above-mentioned eccentric truncated cone shape; a circular bottom surface having the same area as that of the bottom portion of eccentric dimple 1; and a height that is the same as dimple depth B of eccentric dimple 1. In this case, the radius of opening $p_n$ obtained by cutting eccentric dimple 1 having the above-mentioned eccentric truncated cone shape at arbitrary depth $d_n$ is the same as the radius of the opening obtained by cutting the virtual dimple having a truncated cone shape at depth $d_n$.

For eccentric dimple 1 configured as described above, a "dimple axis $ax_d$" is uniquely defined that passes through center point c of dimple plane dp and dimple deepest portion bt in a plan view as shown in FIG. 2. On golf ball 100, dimple axis $ax_d$ of each eccentric dimple 1 has a unique rotation angle ω1 with respect to a reference axis that is arbitrarily set on golf ball 100. All eccentric dimples 1 have rotation angles ω1 having uneven values. In other words, in all of eccentric dimples 1, dimple axes $ax_d$ are oriented on golf ball 100 in random directions without regularity. This unevenness of rotation angles ω1 will be described with reference to FIGS. 4 and 5.

Figure 4:
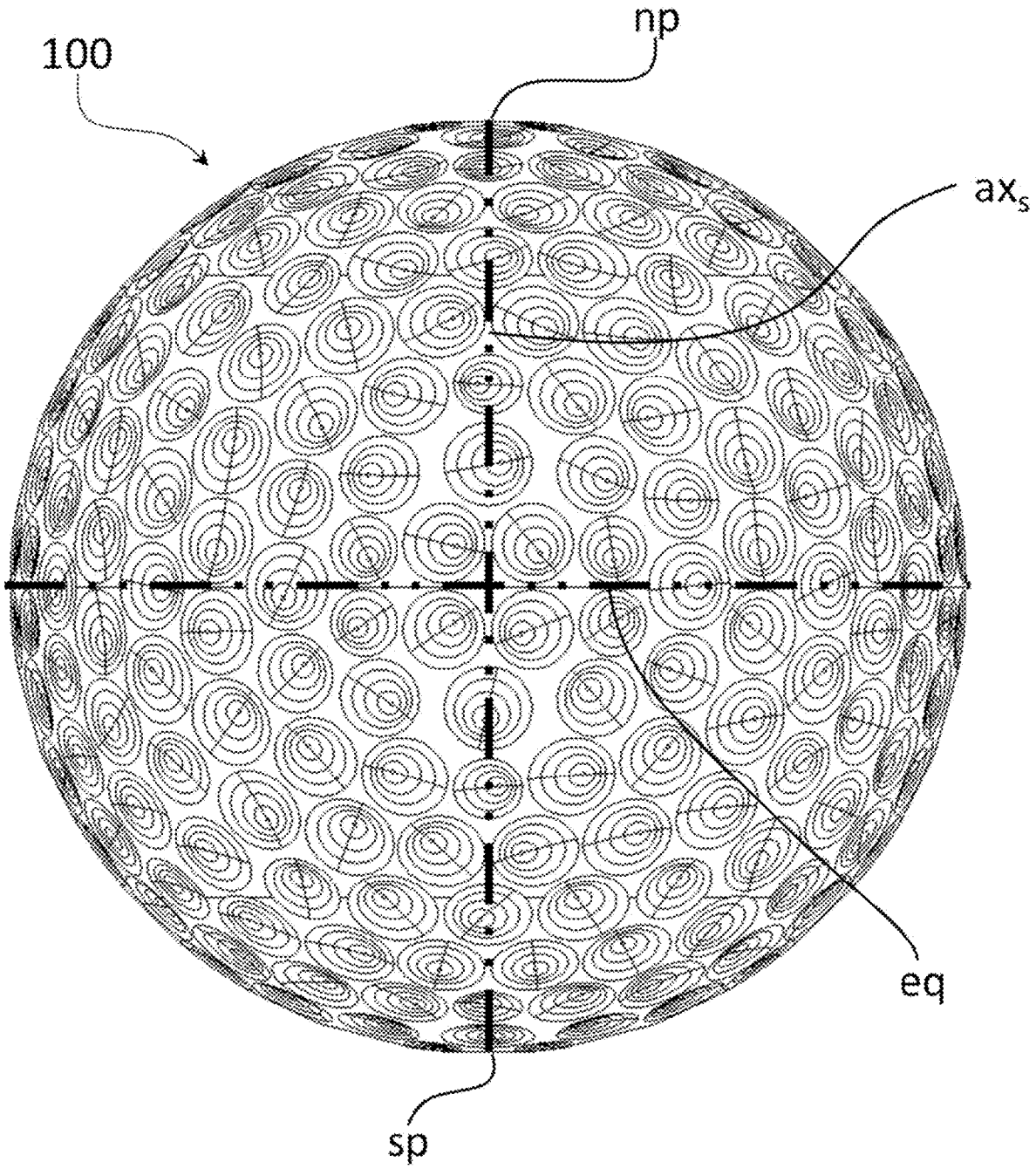
FIG. 4 is a schematic front view showing the state where the dimples are eccentrically located in the golf ball according to the first embodiment of the present invention.
Figure 5:
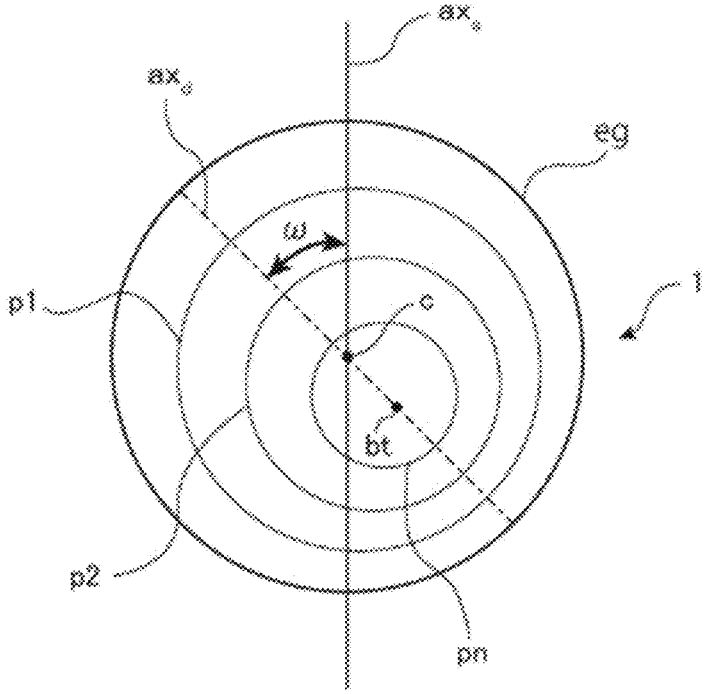
FIG. 5 is a plan view of a dimple in the golf ball according to the first embodiment of the present invention.

FIG. 4 is a diagram schematically showing the state where eccentric dimples 1 are eccentrically located in golf ball 100. Referring to FIG. 4, golf ball 100 has a parting line defined as an equator eq. An upper pole np is defined in a portion above equator eq while a lower pole sp is defined in a portion below equator eq. One arbitrary large circle that passes through upper pole np and lower pole sp is defined as a "reference axis $ax_s$". FIG. 5 is a plan view of eccentric dimple 1 disposed in upper pole np. In FIG. 5, center point c of dimple plane dp and upper pole np coincide with each other in a plan view.

All of eccentric dimples 1 are assumed to be located at upper pole np and then changed in position to be located at their respective desired positions on the surface of golf ball 100 that are specified by respective latitudes and longitudes. In this case, eccentric dimple 1 disposed at upper pole np has a prescribed rotation angle ω1 between reference axis $ax_s$ and dimple axis $ax_d$ in accordance with the degree of rotation of eccentric dimple 1 around upper pole np. This rotation angle ω1 has a unique value indicating the direction of eccentric dimple 1 even after each eccentric dimple 1 located at upper pole np is changed in position to be located at its desired position on golf ball 100.

According to golf ball 100 in the present first embodiment, all eccentric dimples 1 have uneven rotation angles ω1. It is preferable that: rotation angle ω1 is equal to or greater than $-\pi$ and equal to or less than $\pi$; an average value (ω1_ave) of the rotation angles of all eccentric dimples 1 is equal to or greater than $-\pi/18$ and equal to or less than $-\pi/18$ as a range ensuring the uneven angles; and a standard deviation ($\omega_{SD}$) of the rotation angles of all eccentric dimples 1 has a variable value equal to or greater than $4\pi/9$. For example, χ1 showing randomness may be uniformly distributed random numbers including values of zero or more and 1 or less as long as it is represented by the equation of rotation angle $\omega 1=2*\pi*\chi 1$(rad), and it satisfies the above-mentioned average value (ω1_ave) and the range of the above-mentioned standard deviation (ωSD) of the rotation angles.

In addition, reference axis $ax_s$ does not necessarily have to be a large circle that passes through upper pole np and lower pole sp but may be any axis as long as it can provide a reference in a common direction with respect to dimple axis $ax_d$ of each of eccentric dimples 1 disposed on golf ball 100.

The following is a specific example of the configuration of eccentric dimple 1 configured as described above.

$L_1$ dimple 11 has: diameter D of 4.27 mm, for example; depth B of 0.134 mm or more and 0.202 mm or less, for example; volume V of 1.004 $mm^3$ or more and 1.506 $mm^3$ or less, for example; and displacement ratio Q of 0.1 or more and 0.4 or less, for example.

$LS_1$ dimple 12 has: diameter D of 4.06 mm, for example; depth B of 0.142 mm or more and 0.214 mm or less, for example; volume V of 0.955 $mm^3$ or more and 1.433 $mm^3$ or less, for example; and displacement ratio Q of 0.1 or more and 0.4 or less, for example.

$M_1$ dimple 13 has: diameter D of 3.80 mm, for example; depth B of 0.154 mm or more and 0.232 mm or less, for example; volume V of 0.883 $mm^3$ or more and 1.325 $mm^3$ or less, for example; and displacement ratio Q of 0.1 or more and 0.4 or less, for example.

$S_1$ dimple 14 has: diameter D of 3.25 mm, for example; depth B of 0.111 mm or more and 0.166 mm or less, for example; volume V of 0.508 $mm^3$ or more and 0.762 $mm^3$ or less, for example; and displacement ratio Q of 0.1 or more and 0.4 or less, for example.

$SS_1$ dimple 15 has: diameter D of 2.73 mm, for example; depth B of 0.117 mm or more and 0.175 mm or less, for example; volume V of 0.368 $mm^3$ or more and 0.552 $mm^3$ or less, for example; and displacement ratio Q of 0.1 or more and 0.4 or less, for example.

The entire structure of golf ball 100 will be hereinafter described.

The diameter of the golf ball is required to be 42.67 mm or more according to the regulations (see R & A and USGA). However, in consideration of aerodynamic characteristics and the like, it is preferable that the diameter of a golf ball is made as small as possible, and for example, may be 42.67 mm or more and 43.70 mm or less. Also, the weight of the golf ball is required to be 45.93 g or less according to the regulations. In consideration of aerodynamic characteristics, it is preferable that the weight of the golf ball is made as heavy as possible, and for example, may be 45.2 g or more and 45.93 g or less.

Figure 6:
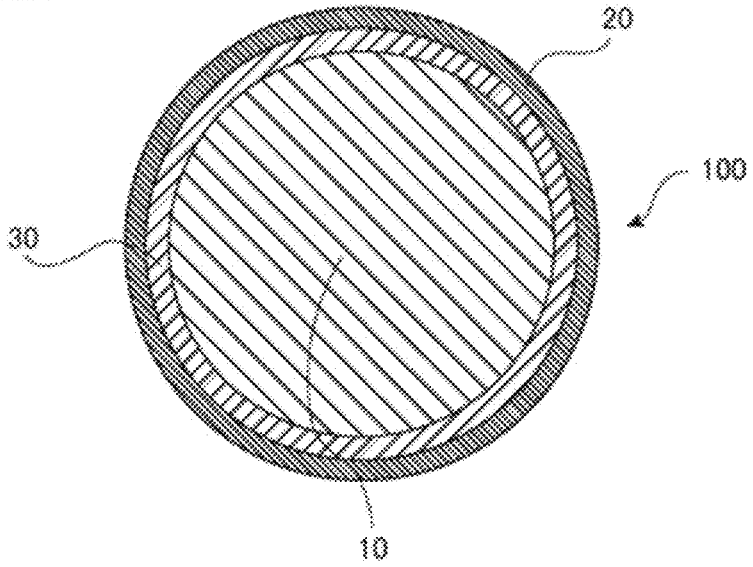
FIG. 6 is a cross-sectional view of the golf ball according to the first embodiment of the present invention.

With reference to FIG. 6, golf ball 100 is provided with a core 10, a cover 20, and an intermediate layer 30. Core 10 is covered by cover 20 and intermediate layer 30. Intermediate layer 30 is covered by cover 20. Golf ball 100 is further provided with a paint layer and a mark layer outside cover 20, but these layers are not shown in the drawings for convenience of explanation.

Core 10 is generally formed to have a spherical shape. However, a plurality of evenly separated protrusions or uniformly distributed concave portions may be provided on the surface of spherical core 10. When the protrusions are provided, it is preferable that the concave portions partitioned by the protrusions are filled with a plurality of enveloping layers or a single enveloping layer covering each of the concave portions, so as to form a spherical body formed by core 10 and the enveloping layer. When the concave portions are provided, it is preferable that the concave portions are filled with an outer layer covering core 10 so as to form a spherical shape.

Core 10 is formed in a spherical shape. Core 10 is made of a rubber composition. The diameter of core 10 is 38.3 mm, for example. The weight of core 10 is 33.7 g, for example. If core 10 is too small, the repulsion performance of the ball decreases. If core 10 is too large, the thickness of cover 20 and intermediate layer 30 covering core 10 is too small, which decreases the durability of the ball or leads to an excessively softened ball, thereby decreasing the repulsion performance of the ball.

Core 10 may be prepared from a rubber composition containing a base rubber, a crosslinking agent, a metal salt of unsaturated carboxylic acid, a filler and the like. As the base rubber, for example, polybutadiene may be used. As the crosslinking agent, for example, dicumyl peroxide may be used. As the metal salt of unsaturated carboxylic acid, for example, zinc acrylate may be used. As the filler, for example, zinc oxide or magnesium carbonate may be used.

Cover 20 is made of an elastomer. The surface of cover 20 is provided with a plurality of eccentric dimples. The diameter of cover 20 is 42.7 mm, for example. As the material for cover 20, thermoplastic polyurethane may be used.

Cover 20 may be formed by any known methods such as an injection molding method, a compression molding method, a cast molding method, and the like. A plurality of eccentric dimples may be formed on the surface of cover 20 when molding cover 20. After the molding, processes of deburring, cleaning, polishing, painting and mark printing are carried out as required, to thereby prepare a golf ball.

Intermediate layer 30 is provided between core 10 and cover 20. Intermediate layer 30 may be a single layer or two or more layers. The diameter of intermediate layer 30 is 40.5 mm, for example. The weight of intermediate layer 30 is 38.8 g, for example. Intermediate layer 30 may be made of an ionomer.

The function and effect of golf ball 100 according to the present invention configured as described above will be hereinafter described.

In general, on a golf ball, the flow of air is separated by dimples from the surface of the golf ball. Thereby, the air flow is changed from a laminar flow to a turbulent flow so as to be separated from the surface of the golf ball. The flow separated from the surface again adheres to the surface of the golf ball by the turbulent flow, so that the position of re-separation of the flow from the ball surface shifts to be located backward on the ball surface in the ball flying direction. Thereby, the area of the low pressure portion on the golf ball located backward in its flying direction is reduced, thereby reducing the pressure difference between the forward area and the backward area on the golf ball in its flying direction. Thus, the drag decreases. In other words, the air flow is changed from a laminar flow to a turbulent flow to thereby reduce the drag. Accordingly, it is aerodynamically preferable that the flow of air around the golf ball is changed to a turbulent flow at an early stage.

In this case, the flow of air is more likely to be separated as the edge angle of a dimple is larger. The edge angle of a dimple means an angle that is formed between dimple plane dp and dimple surface df in an extremely small section around dimple edge eg. Eccentric dimple 1 in the present invention has one maximum edge angle and one minimum edge angle, each of which is formed between dimple plane dp and dimple surface df. The edge angle varies depending on displacement amount $\delta_{bt}$ in deepest portion bt of eccentric dimple 1. As displacement amount $\delta_{bt}$ is larger, the maximum edge angle becomes larger and the minimum edge angle becomes smaller.

In the case of a normal dimple not having eccentricity, as the edge angle is larger, the dimple becomes deeper, which causes a problem that drag in a high speed region increases. In contrast, in the present invention, the position of deepest portion bt is displaced without changing the depth of each dimple, thereby increasing the edge angle. Also, only by such larger edge angles, it is difficult to achieve the effect of these larger edge angles unless these larger edge angles are located at forward positions in their respective dimples in the ball flying direction. In the present invention, dimples are arranged such that larger edge angles are located in uneven directions, so that larger edge angles exist at forward positions in their respective dimples in the ball flying direction with a certain probability. Thereby, the drag of golf ball 100 can be reduced, so that the ball flying characteristics can be improved.

Second Embodiment

Then, a golf ball 200 according to the second embodiment of the present invention will be described. In the following description, the same components as those of golf ball 100 in the above-mentioned first embodiment will be designated by the same reference characters, and the description thereof will not be repeated.

Figure 7:
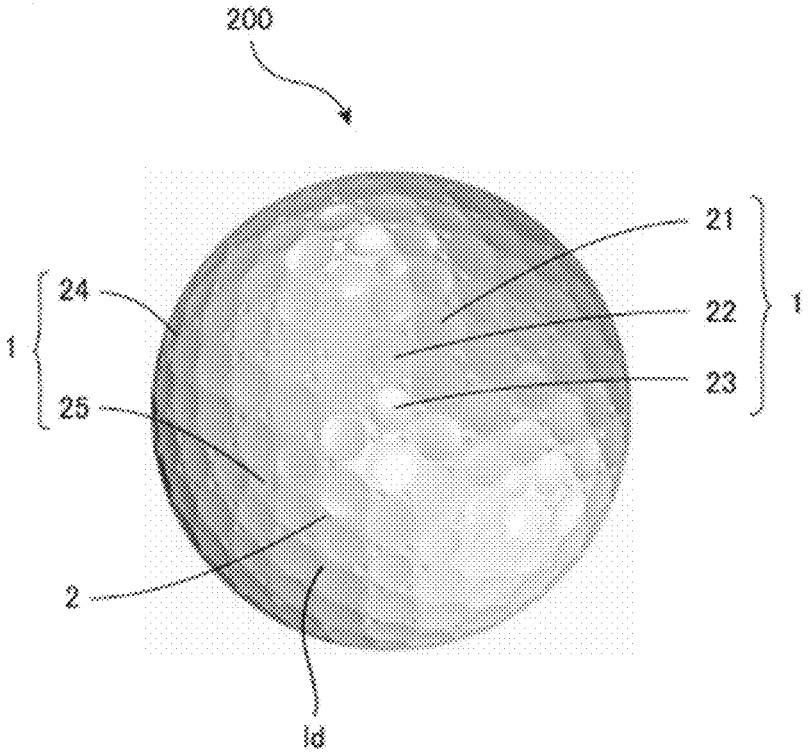
FIG. 7 is a schematic front view of a golf ball according to the second embodiment of the present invention.

FIG. 7 is a schematic front view of golf ball 200 according to the present second embodiment. Referring to FIG. 7, golf ball 200 includes a plurality of eccentric dimples 1 and a plurality of normal dimples 2 each having no eccentricity. Normal dimple 2 has a spherical dome shape, in which a dimple center point c of a dimple plane dp and a deepest portion bt coincide with each other in a plan view. In other words, in normal dimple 2, dimple deepest portion bt is located on a dimple vertical line vl.

Also in normal dimple 2, a dimple edge eg, a dimple plane dp, a dimple surface df, and an opening $p_n$ at an arbitrary depth $d_n$ are defined as in eccentric dimple 1. Normal dimple 2 has a diameter D corresponding to the diameter of dimple plane dp formed by dimple edge eg of normal dimple 2. Normal dimple 2 has an area S corresponding to the area of dimple plane dp. Normal dimple 2 has a depth B corresponding to the longest vertical distance from dimple plane dp to dimple surface df. Normal dimple 2 has a volume V corresponding to the volume of the space surrounded by dimple plane dp and dimple surface df.

In golf ball 200 according to the present second embodiment, normal dimple 2 is configured as an extremely small dimple disclosed as the "second dimple" in Japanese Patent Laying-Open No. 2014-204950. Normal dimple 2 is disposed in some of land portions ld that each are located in a triangle surrounded by three adjoining eccentric dimples 1. Thus, normal dimples are arranged evenly over the entire surface of golf ball 200.

Normal dimple 2 has: diameter D of 1.24 mm, for example; and depth B of 0.158 $mm^3$, for example. The number of normal dimples 2 is 294, for example. Normal dimple 2 has volume V of 0.100 $mm^3$, for example. The total volume obtained by totaling volumes V of normal dimples 2 is 29.43 $mm^3$, for example.

By forming normal dimple 2 as an extremely small dimple, not only the effect of reducing the drag by eccentric dimple 1 can be achieved, but also the effect of increasing the lift by dimple 2 can be achieved as disclosed in detail in Japanese Patent Laying-Open No. 2014-204950. It should be noted that the disclosure in Japanese Patent Laying-Open No. 2014-204950 is also applicable to golf ball 200 in the present second embodiment in the applicable scope. Furthermore, normal dimple 2 is not limited to an extremely small dimple, but also may be a dimple having the same diameter as that of eccentric dimple 1, may be a dimple having a diameter larger than that of eccentric dimple 1, or may be a dimple having a diameter smaller than that of eccentric dimple 1.

In golf ball 200 including eccentric dimples 1 and normal dimples 2, displacement ratio Q of eccentric dimple 1 is preferably 0.1 or more and 0.3 or less. Furthermore, the proportion of the total area of eccentric dimples 1 to the total area of all types of dimples is more preferably 30% or less. Thereby, the effect of reducing drag by eccentric dimple 1 can be sufficiently achieved.

Then, the arrangement of dimples in golf ball 200 in the present second embodiment will be described. Again referring to FIG. 7, a dimple is disposed in each of triangle areas obtained by sectioning an icosahedron as an imaginary shape of a spherical surface.

Eccentric dimple 1 includes an $LL_2$ dimple 21, an $L_2$ dimple 22, an $LS_2$ dimple 23, an $M_2$ dimple 24, and an $S_2$ dimple 25 in descending order of diameter size. Normal dimple 2 includes an $SS_2$ dimple 26. $LL_2$ dimple 21 has the largest diameter while $SS_2$ dimple 26 has the smallest diameter. In this way, a plurality of dimples arranged in golf ball 200 are a combination of dimples having a plurality of different diameters.

The number of eccentric dimples 1 is 150 or more and 350 or less, for example. The number of eccentric dimples 1 may be 272, for example. The number of $LL_2$ dimples 21 is 150, for example. The number of $L_2$ dimples 22 is 24, for example. The number of $LS_2$ dimples 23 is 74, for example. The number of $M_2$ dimples 24 is 12, for example. The number of $S_2$ dimples 25 is 12, for example. The number of $SS_2$ dimples 26 as normal dimples 2 is 294, for example.

The following are specific examples of the configurations of eccentric dimple 1 and normal dimple 2 disposed in golf ball 200.

$LL_2$ dimple 21 has: diameter D of 4.70 mm, for example; depth B of 0.132 mm or more and 0.198 mm or less, for example; volume V of 1.240 $mm^3$ or more and 1.860 $mm^3$ or less, for example; and displacement ratio Q of 0.1 or more and 0.4 or less, for example.

$L_2$ dimple 22 has: diameter D of 4.27 mm, for example; depth B of 0.156 mm or more and 0.234 mm or less, for example; volume V of 1.131 $mm^3$ or more and 1.414 $mm^3$ or less, for example; and displacement ratio Q of 0.1 or more and 0.4 or less, for example.

$LS_2$ dimple 23 has: diameter D of 4.06 mm, for example; depth B of 0.160 mm or more and 0.240 mm or less, for example; volume V of 1.042 $mm^3$ or more and 1.563 $mm^3$ or less, for example; and displacement ratio Q of 0.1 or more and 0.4 or less, for example.

$M_2$ dimple 24 has: diameter D of 3.80 mm, for example; depth B of 0.168 mm or more and 0.252 mm or less, for example; volume V of 0.960 $mm^3$ or more and 1.440 $mm^3$ or less, for example; and displacement ratio Q of 0.1 or more and 0.4 or less, for example.

$S_2$ dimple 25 has: diameter D of 2.78 mm, for example; depth B of 0.104 mm or more and 0.156 mm or less, for example; volume V of 0.316 $mm^3$ or more and 0.474 $mm^3$ or less, for example; and displacement ratio Q of 0.1 or more and 0.4 or less, for example.

$SS_2$ dimple 26 has: diameter D of 1.24 mm, for example; depth B of 0.126 mm or more and 0.190 mm or less, for example; volume V of 0.080 $mm^3$ or more and 0.120 $mm^3$ or less, for example; and displacement ratio Q of 0, so that $SS_2$ dimple 26 is a normal dimple with no displacement.

The total volume obtained by totaling volumes V of eccentric dimples 1 and volumes V of normal dimples 2 is 329.15 $mm^3$ or more and 493.72 $mm^3$ or less, and is preferably 370.29 $mm^3$ or more and 452.58 $mm^3$ or less.

Then, the function and effect of golf ball 200 according to the present second embodiment will be described.

In golf ball 200, in addition to the function and effect achieved by eccentric dimple 1 described in the first embodiment, the combination of the dimple arrangement patterns can be increased by including normal dimples 2. Furthermore, by forming normal dimples 2 as extremely small dimples, the increase in lift-drag ratio by the increased lift can be controlled, so that the orbit of the golf ball can be adjusted so as to satisfy the user's needs.

Examples

In the following, examples of the present invention will be described. Examples 1 to 3 each are a golf ball corresponding to the above-mentioned first embodiment. Example 4 is a golf ball corresponding to the above-mentioned second embodiment. Comparative Examples 1 and 2 each are a golf ball including only normal dimples 2 but not including eccentric dimples 1. The specific configurations of Examples 1 to 4 and Comparative Examples 1 and 2 will be described below.

TABLE 1

| | | Example 1 | Example 2 | Example 3 | Example 4 | Comparative Example 1 | Comparative Example 2 |
|---|---|---|---|---|---|---|---|
| LL | Diameter (mm) | — | — | — | 4.70 | — | 4.70 |
| | Depth (mm) | — | — | — | 0.165 | — | 0.165 |
| | Volume ($mm^3$) | — | — | — | 1.550 | — | 1.550 |
| | Number (pieces) | — | — | — | 150 | — | 150 |
| | Total Volume ($mm^3$) | — | — | — | 232.51 | — | 232.51 |
| | Displacement Ratio | — | — | — | 0.3 | — | 0.0 |
| L | Diameter (mm) | 4.27 | 4.27 | 4.27 | 4.27 | 4.27 | 4.27 |
| | Depth (mm) | 0.168 | 0.168 | 0.168 | 0.195 | 0.168 | 0.195 |
| | Volume ($mm^3$) | 1.255 | 1.255 | 1.255 | 1.414 | 1.255 | 1.414 |
| | Number (pieces) | 120 | 120 | 120 | 24 | 120 | 24 |
| | Total Volume ($mm^3$) | 150.62 | 150.62 | 150.62 | 33.94 | 150.62 | 33.94 |
| | Displacement Ratio | 0.1 | 0.3 | 0.4 | 0.3 | 0.0 | 0.0 |
| LS | Diameter (mm) | 4.06 | 4.06 | 4.06 | 4.06 | 4.06 | 4.06 |
| | Depth (mm) | 0.178 | 0.178 | 0.178 | 0.200 | 0.178 | 0.200 |
| | Volume ($mm^3$) | 1.194 | 1.194 | 1.194 | 1.303 | 1.194 | 1.303 |
| | Number (pieces) | 134 | 134 | 134 | 74 | 134 | 74 |
| | Total Volume ($mm^3$) | 160.01 | 160.01 | 160.01 | 96.41 | 160.01 | 96.41 |
| | Displacement Ratio | 0.1 | 0.3 | 0.4 | 0.3 | 0.0 | 0.0 |

TABLE 1-continued

| | | Example 1 | Example 2 | Example 3 | Example 4 | Comparative Example 1 | Comparative Example 2 |
|---|---|---|---|---|---|---|---|
| M | Diameter (mm) | 3.80 | 3.80 | 3.80 | 3.80 | 3.80 | 3.80 |
| | Depth (mm) | 0.193 | 0.193 | 0.193 | 0.210 | 0.193 | 0.210 |
| | Volume ($mm^3$) | 1.104 | 1.104 | 1.104 | 1.200 | 1.104 | 1.200 |
| | Number (pieces) | 72 | 72 | 72 | 12 | 72 | 12 |
| | Total Volume ($mm^3$) | 79.47 | 79.47 | 79.47 | 14.40 | 79.47 | 14.40 |
| | Displacement Ratio | 0.1 | 0.3 | 0.4 | 0.3 | 0.0 | 0.0 |
| S | Diameter (mm) | 3.25 | 3.25 | 3.25 | 2.78 | 3.25 | 2.78 |
| | Depth (mm) | 0.138 | 0.138 | 0.138 | 0.130 | 0.138 | 0.130 |
| | Volume ($mm^3$) | 0.635 | 0.635 | 0.635 | 0.395 | 0.635 | 0.395 |
| | Number (pieces) | 32 | 32 | 32 | 12 | 32 | 12 |
| | Total Volume ($mm^3$) | 20.32 | 20.32 | 20.32 | 4.74 | 20.32 | 4.74 |
| | Displacement Ratio | 0.1 | 0.3 | 0.4 | 0.3 | 0.0 | 0.0 |
| SS | Diameter (mm) | 2.73 | 2.73 | 2.73 | 1.24 | 2.73 | 1.24 |
| | Depth (mm) | 0.146 | 0.146 | 0.146 | 0.158 | 0.146 | 0.158 |
| | Volume ($mm^3$) | 0.460 | 0.460 | 0.460 | 0.100 | 0.460 | 0.100 |
| | Number (pieces) | 8 | 8 | 8 | 294 | 8 | 294 |
| | Total Volume ($mm^3$) | 3.68 | 3.68 | 3.68 | 29.43 | 3.68 | 29.43 |
| | Displacement Ratio | 0.1 | 0.3 | 0.4 | 0.0 | 0.0 | 0.0 |

Table 1 shows the dimple configuration in the golf ball in each of Examples 1 to 4 and Comparative Examples 1 and 2. The golf balls in Examples 1 to 3 each include L dimples, LS dimples, M dimples, S dimples, and SS dimples, each of which is formed as eccentric dimple 1. The golf balls in Examples 1 to 3 exhibit different displacement ratios Q. The golf ball in Example 1 exhibits displacement ratio Q=0.1. The golf ball in Example 2 exhibits displacement ratio Q=0.3. The golf ball in Example 3 exhibits displacement ratio Q=0.4.

Example 4 includes eccentric dimples 1 and normal dimples 2. Eccentric dimples 1 include an LL dimple, an L dimple, an LS dimple, an M dimple, and an S dimple. Normal dimples 2 include an SS dimple. Eccentric dimple 1 exhibits displacement ratio Q=0.3.

Comparative Example 1 is identical in arrangement of dimples and size configuration of dimples to Examples 1 to 3. Comparative Example 1 is however different from Examples 1 to 3 in that all dimples are normal dimples each exhibiting displacement ratio Q=0.0. Comparative Example 2 is identical in arrangement of dimples and size configuration of dimples to Example 4. Comparative Example 2 is however different from Example 4 in that all dimples are normal dimples each exhibiting displacement ratio Q=0.0.

Figure 8:
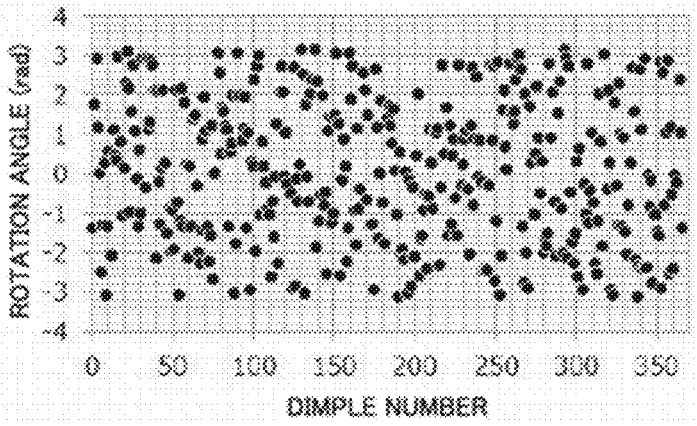
FIG. 8 is a diagram showing distribution of rotation angles of eccentric dimples in a golf ball in Example 1.
Figure 9:
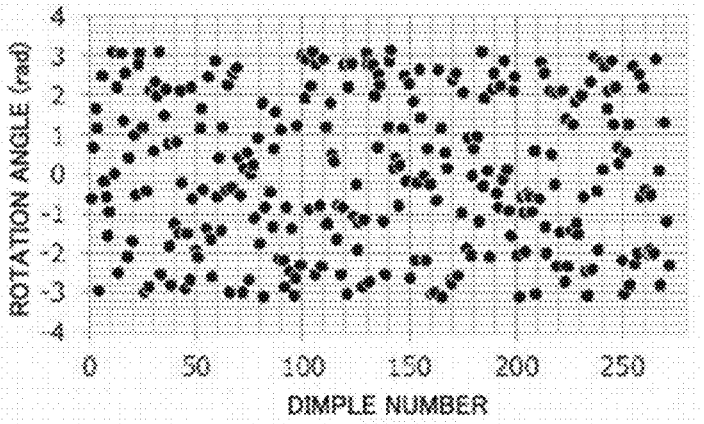
FIG. 9 is a diagram showing distribution of rotation angles of eccentric dimples in a golf ball in Example 2.

FIG. 8 shows distribution of rotation angles w of eccentric dimples 1 arranged in a golf ball in each of Examples 1 to 3. FIG. 9 shows distribution of rotation angles w of eccentric dimples 1 arranged in a golf ball in Example 4. As shown in FIGS. 8 and 9, rotation angles ω of dimples in each of Examples 1 to 4 are entirely unevenly distributed. Table 2 shows an average of rotation angles ω and a standard deviation of rotation angles ω in each of Examples 1 to 4.

TABLE 2

| | Examples 1 to 3 | Example 4 |
|---|---|---|
| Rotation Angle Average ω_ave(rad) | −0.01 | 0.05 |
| Rotation Angle Standard Deviation ωsd(rad) | 1.66 | 1.79 |

The golf balls in Examples 1 to 4 and Comparative Examples 1 to 2 configured as described above were used to examine: the relation among the ball speed, a lift coefficient Cl and a spin parameter Sp; and the relation among the ball speed, a drag coefficient Cd and spin parameter Sp. Spin parameter Sp is defined by the following equation (1). The spin parameter is represented by the circumferential speed/speed.

$$Sp=\pi d_n/U \quad (1)$$

In the equation (1), d is a diameter (m), N is a rotation speed (rps), and U is a ball speed (m/s). For example, the ball speed (pace of the ball) of 60 m/s and the rotation speed of 2700 rpm lead to spin parameter Sp≈0.1.

Lift coefficient Cl and drag coefficient Cd can be calculated from three component forces (drag, lift, and lateral force) of aerodynamic force produced by blowing of air onto a rotating golf ball using an aerodynamic force measurement device as disclosed in Japanese Patent No. 4982148. The spin parameter can be changed as appropriate by adjusting the flow velocity of the blowing air and the rotating speed of a golf ball. Furthermore, the lift coefficient can be measured by using a method of conducting a calculation based on the orbit measured using an infrared sensor or by using a golf ball orbit measuring device represented by TrackMan available from TrackMan.

As to the initial speed of a golf ball at the time when the golf ball is hit and launched, the average value of the initial speeds by amateur male golf players is about 60 m/s, and the average value of the initial speeds by professional male golf players is about 70 m/s. On the other hand, as disclosed in "Aerodynamic Force Measurement of Highly Spinning Golf Ball in Uniform Flow and Trajectory Experiment" by Takeshi Naruo, Takehito Mizota, and Hitoshi Shimozono (2004, The Japan Society of Mechanical Engineers; Journal B Edition, Vol. 70, No. 697, pages 2371 to 2377), the lift coefficient and the drag coefficient are not depending on the Reynolds number, that is, do not exhibit speed dependency, at the flow velocity of 35 m/s to 80 m/s, but the initial speed at the time when a golf ball is hit and launched is dependent only on the spin parameter. From the above description, the experiments were conducted at the flow velocity of 44 m/s at maximum in the present example. However, if a prescribed rotating speed is obtained, the aerodynamic force characteristics at the flow velocity up to 80 m/s in the above-mentioned flow velocity range can be obtained.

Figure 10:
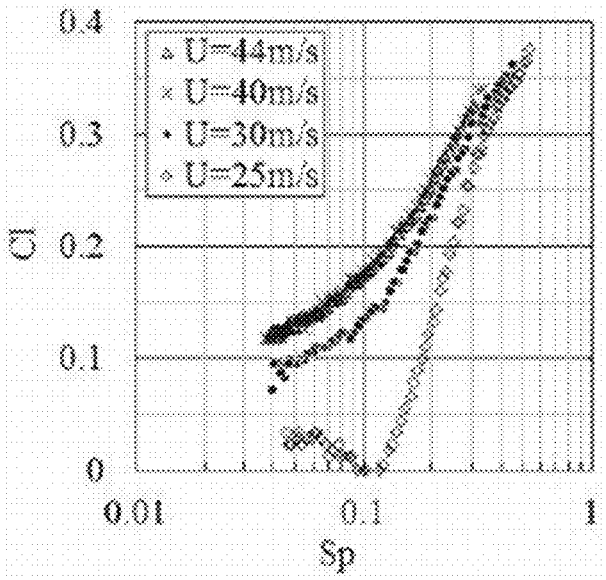
FIG. 10 is a diagram showing the relation between a lift coefficient and a spin parameter in Example 1.
Figure 11:
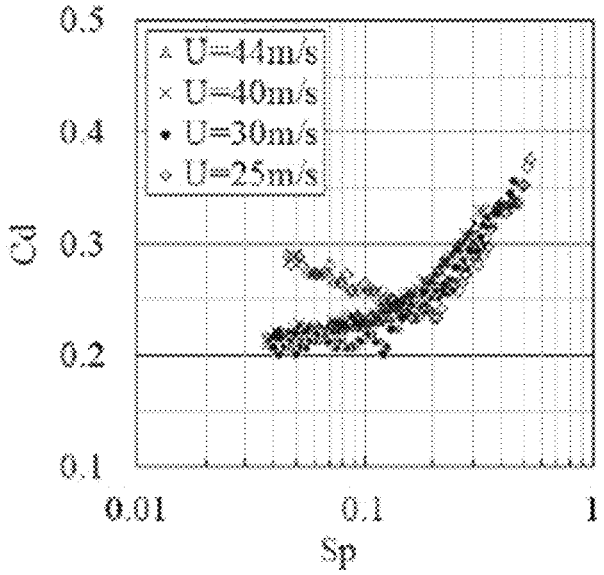
FIG. 11 is a diagram showing the relation between a drag coefficient and the spin parameter in Example 1.
Figure 12:
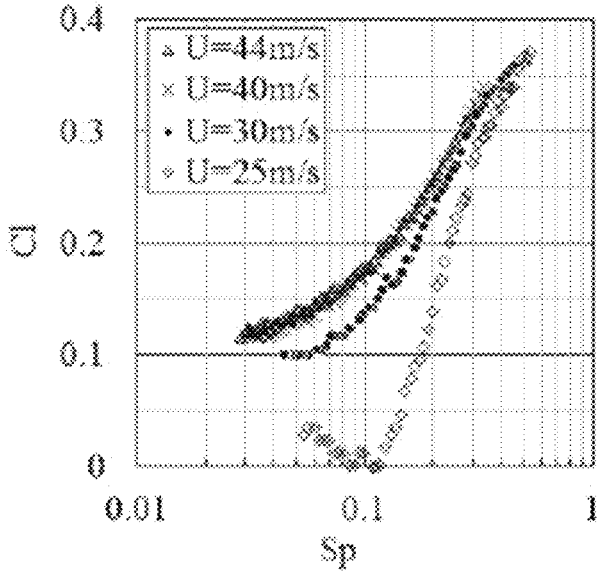
FIG. 12 is a diagram showing the relation between a lift coefficient of and a spin parameter in Example 2.
Figure 13:
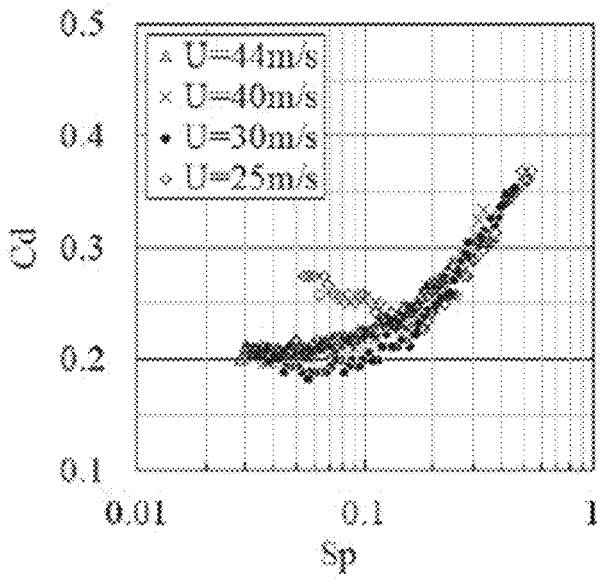
FIG. 13 is a diagram showing the relation between a drag coefficient and the spin parameter in Example 2.
Figure 14:
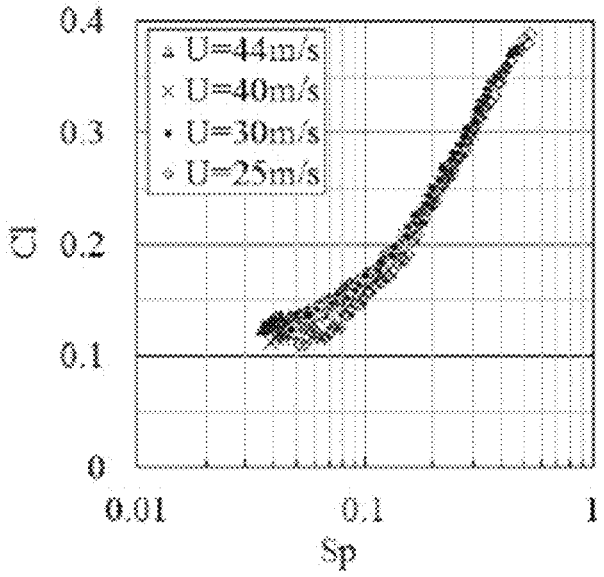
FIG. 14 is a diagram showing the relation between a lift coefficient and a spin parameter in Example 3.
Figure 15:
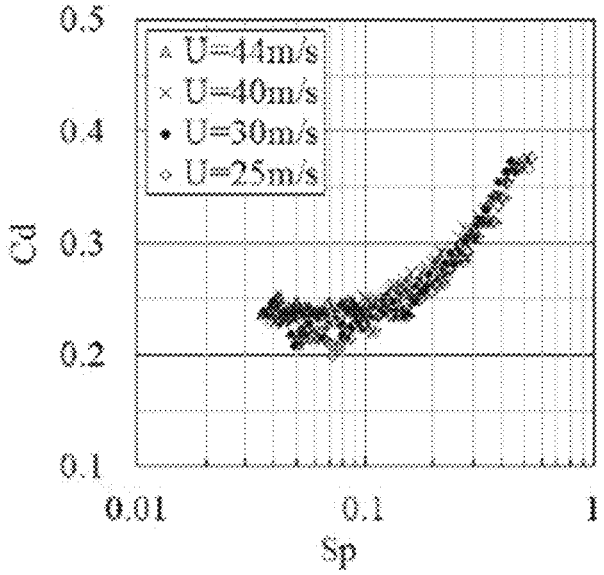
FIG. 15 is a diagram showing the relation between a drag coefficient and the spin parameter in Example 3.
Figure 16:
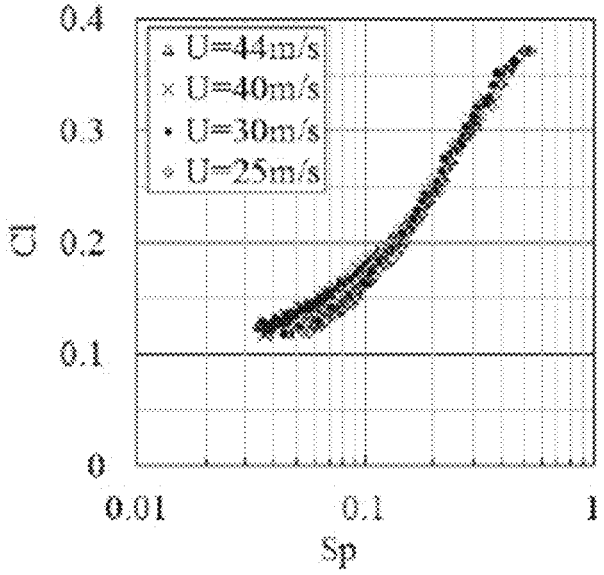
FIG. 16 is a diagram showing the relation between a lift coefficient and a spin parameter in Example 4.
Figure 17:
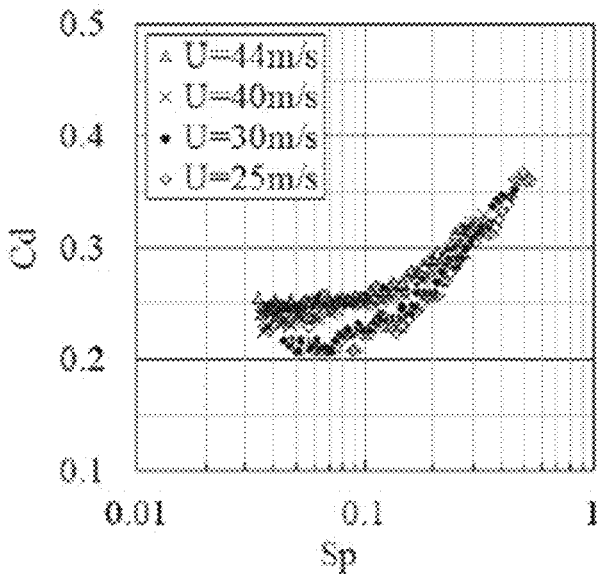
FIG. 17 is a diagram showing the relation between a drag coefficient and the spin parameter in Example 4.

FIG. 10 is a diagram showing the relation between lift coefficient Cl and the spin parameter in Example 1. FIG. 11 is a diagram showing the relation between drag coefficient Cd and the spin parameter in Example 1. Furthermore, FIGS. 12 and 13 show the relation between lift coefficient Cl and the spin parameter, and the relation between drag coefficient Cd and the spin parameter, respectively, in Example 2. FIGS. 14 and 15 show the relation between lift coefficient Cl and the spin parameter, and the relation between drag coefficient Cd and the spin parameter, respectively, in Example 3. FIGS. 16 and 17 shows the relation between lift coefficient Cl and the spin parameter, and the relation between drag coefficient Cd and the spin parameter, respectively, in Example 4.

Figure 18:
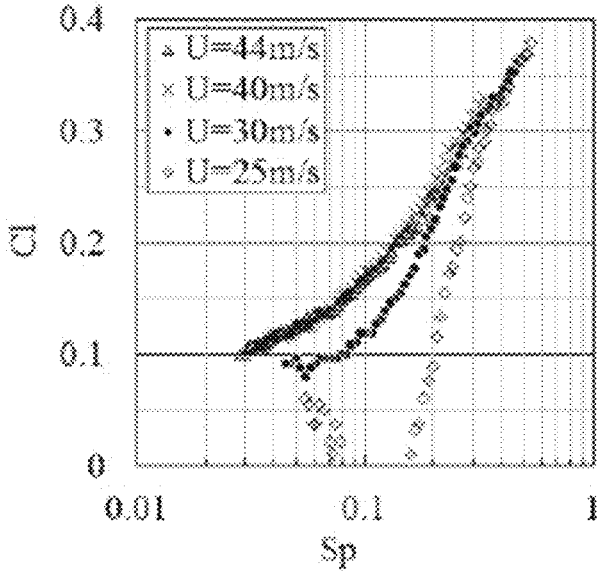
FIG. 18 is a diagram showing the relation between a lift coefficient and a spin parameter in Comparative Example 1.
Figure 19:
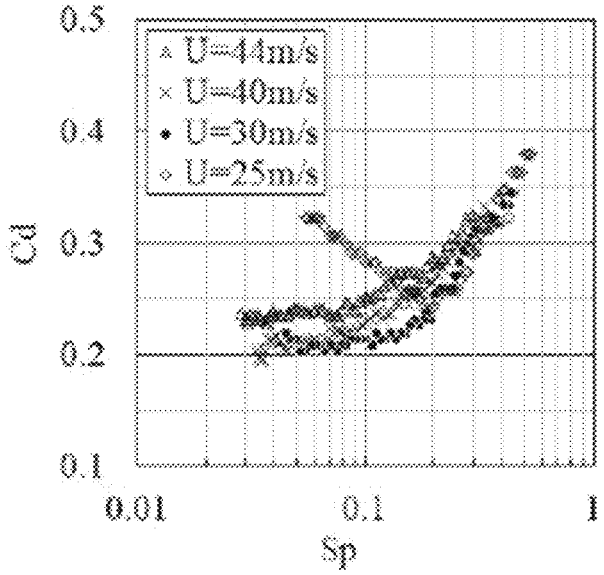
FIG. 19 is a diagram showing the relation between a drag coefficient and the spin parameter in Comparative Example 1.
Figure 20:
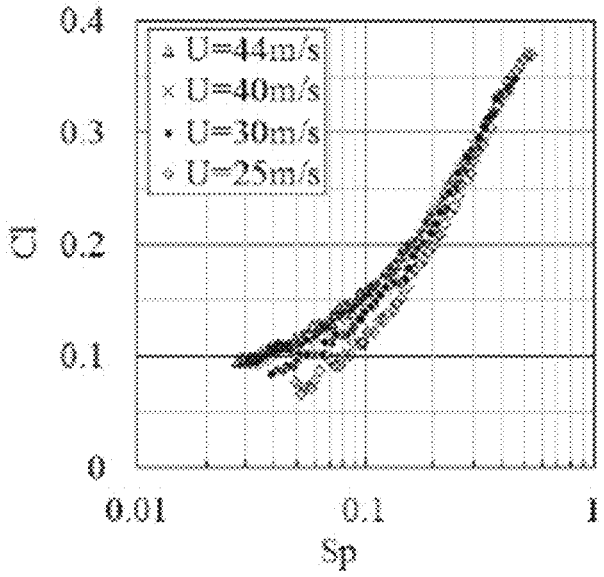
FIG. 20 is a diagram showing the relation between a lift coefficient and a spin parameter in Comparative Example 2.
Figure 21:
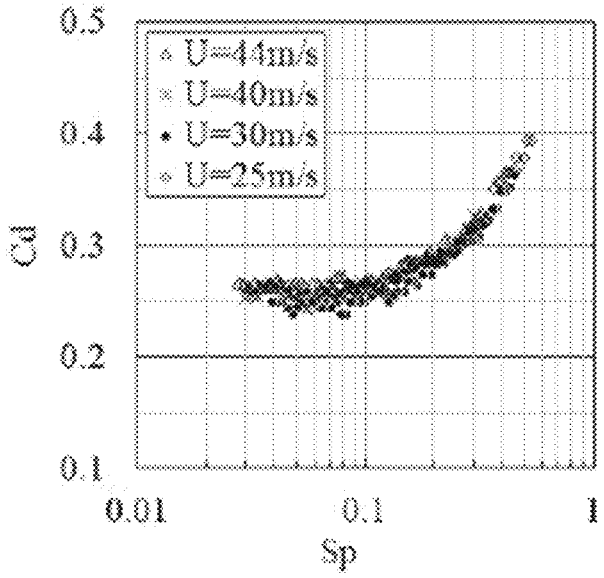
FIG. 21 is a diagram showing the relation between a drag coefficient and the spin parameter in Comparative Example 2.

Furthermore, FIGS. 18 and 19 show the relation between lift coefficient Cl and the spin parameter, and the relation between drag coefficient Cd and the spin parameter, respectively, in Comparative Example 1. FIGS. 20 and 21 show the relation between lift coefficient Cl and the spin parameter, and the relation between drag coefficient Cd and the spin parameter, respectively, in Comparative Example 2.

Referring to FIGS. 10 to 21, specifically in the high speed region at a ball speed of 44 m/s, Examples 1 to 3 are larger in lift coefficient Cl than Comparative Example 1. Furthermore, Examples 1 to 3 are smaller in drag coefficient Cd than Comparative Example 1. Example 2 exhibiting displacement ratio Q=0.3 shows the smallest drag coefficient. When Examples 1 to 3 are compared with Comparative Example 1 at a ball speed of 44 m/s and spin parameter Sp=0.1, Examples 1 to 3 are smaller in drag coefficient Cd and larger in lift coefficient Cl than Comparative Example 1, and thus, improved in lift-drag ratio.

Also, specifically in the high speed region at a ball speed of 44 m/s, Example 4 is larger in lift coefficient Cl and smaller in drag coefficient Cd than Comparative Example 2. When Example 4 is compared with Comparative Example 2 at a ball speed of 44 m/s and spin parameter Sp=0.1, Example 4 is smaller in drag coefficient Cd and larger in lift coefficient Cl than Comparative Example 2, and thus, improved in lift-drag ratio.

The above description shows that, according to the golf ball of the present invention, displacement ratio Q of a plurality of eccentric dimples 1 is set at 0.1 or more and 0.4 or less, thereby reducing the drag coefficient in a high-speed region of 44 m/s, so that the lift coefficient can be increased in all of the speed regions.

Furthermore, the flying distance of the golf ball in each of Examples 1 to 4 and Comparative Examples 1 and 2 was measured through simulations.

The flying distances were compared with one another on three different types of launching conditions. On condition 1, the initial speed was set at 58 m/s, the launch angle was set at 12 degrees, and the spin amount was set at 2800 rpm. On condition 2, the initial speed was set at 63 m/s, the launch angle was set at 15 degrees, and the spin amount was set at 2500 rpm. On condition 3, the initial speed was set at 72 m/s, the launch angle was set at 12 degrees, and the spin amount was set at 2200 rpm. On each of the conditions, the spin angle was set for pure vertical rotation with no tilt.

The flying distance shows the distance of the golf ball flying from the position at which the golf ball is hit on each of the launching conditions to the position at which the golf ball falls again to a level horizontal to the position at which the ball is hit. In this flying distance, the golf ball flies at a temperature of 24° C., at a humidity of 50% and at 1 atmospheric pressure in a windless state, The golf ball used in this case had a mass of 45.6 g, a diameter of 42.8 mm, and a moment of inertia of $8.1\times10^{-6}$ kg·M$^2$.

The air characteristics used for calculating the flying distance were the characteristics of the drag coefficient and the lift coefficient shown in each of FIGS. 10 to 21. The position after the golf ball was hit was calculated using the method disclosed in paragraphs 0032 to 0092 in Japanese Patent No. 3825359.

Table 3 shows launching conditions and simulation results about the flying distance (yard) on each of the launching conditions.

TABLE 3

| Flying Distance (yard) | Condition 1 | Condition 2 | Condition 3 |
|---|---|---|---|
| Initial Speed (m/s) | 58 | 63 | 72 |
| Launch Angle (degrees) | 12 | 14 | 12 |
| Spin Amount (rpm) | 2800 | 2500 | 2200 |
| Example 1 | 192.8 | 220.5 | 267.9 |
| Example 2 | 193.8 | 221.8 | 270.0 |
| Example 3 | 191.9 | 219.7 | 265.9 |
| Example 4 | 191.6 | 219.1 | 264.9 |
| Comparative Example 1 | 191.0 | 218.8 | 264.6 |
| Comparative Example 2 | 188.0 | 215.4 | 260.0 |

In Table 3, Examples 1 to 3 were longer in flying distance than Comparative Example 1 on each of the launching conditions. Also, Example 4 was longer in flying distance than Comparative Example 2. This allows confirmation that the performance for flying distance can be improved by the present invention.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A golf ball comprising:

a land portion; and a plurality of dimples each provided to be recessed with respect to the land portion, the plurality of dimples each having a dimple edge, and a dimple plane surrounded by the dimple edge, wherein the plurality of dimples includes a plurality of eccentric dimples each having a deepest portion that is not located on a line connecting a center point of the dimple plane of a corresponding one of the eccentric dimples and a center point of the golf ball, the plurality of eccentric dimples has respective dimple axes that are oriented randomly in the golf ball, each of the dimple axes being obtained in a plan view of a corresponding one of the eccentric dimples by connecting the center point of the dimple plane and the deepest portion of the corresponding one of the eccentric dimples, each of the randomly oriented dimple axes of the eccentric dimples forms a prescribed rotation angle with a prescribed reference axis extending through a center of the golf ball, the rotation angle is equal to or greater than $-\pi$ and equal to or less than $\pi$, an average value of a plurality of the rotation angles of all of the eccentric dimples is equal to or greater than $-\pi/18$ and equal to or less than $+\pi/18$, and a standard deviation of the rotation angles of all of the eccentric dimples is equal to or greater than $4\pi/9$.

* * * * *